US010184752B2

(12) United States Patent
Tubb

(10) Patent No.: US 10,184,752 B2
(45) Date of Patent: Jan. 22, 2019

(54) FIREARM ACCESSORY MOUNTING INTERFACE, MIRAGE SHIELD AND ERGONOMIC METHOD FOR CONFIGURING RIFLE COMPONENTS AND ACCESSORIES

(71) Applicant: G. David Tubb, Canadian, TX (US)

(72) Inventor: G. David Tubb, Canadian, TX (US)

( * ) Notice: Subject to any disclaimer, the term of this patent is extended or adjusted under 35 U.S.C. 154(b) by 92 days.

(21) Appl. No.: 15/224,646

(22) Filed: Jul. 31, 2016

(65) Prior Publication Data

US 2017/0138692 A1 May 18, 2017

Related U.S. Application Data

(60) Provisional application No. 62/274,054, filed on Dec. 31, 2015, provisional application No. 62/199,139, filed on Jul. 30, 2015.

(51) Int. Cl.
*F41C 23/16* (2006.01)
*F41A 21/44* (2006.01)

(52) U.S. Cl.
CPC ..... *F41C 23/16* (2013.01); *F41A 21/44* (2013.01)

(58) Field of Classification Search
CPC combination set(s) only.
See application file for complete search history.

(56) References Cited

U.S. PATENT DOCUMENTS 4,275,625 A * 6/1981 Tomlinson ..... B23Q 1/0063 82/129
6,609,321 B2 * 8/2003 Faifer ..... F41C 23/16 42/124
6,836,990 B2 * 1/2005 Shiloni ..... F41G 11/003 42/75.02
7,568,304 B1 * 8/2009 Moody ..... F41A 23/08 42/71.01
D641,450 S * 7/2011 Ding ..... D22/108
8,037,633 B1 * 10/2011 Troy ..... F41C 23/16 42/71.01
8,336,243 B2 * 12/2012 Langevin ..... F41C 23/16 42/71.01
8,371,056 B1 * 2/2013 Baker ..... F41G 11/003 42/106
8,402,684 B1 * 3/2013 Beltz ..... F41A 23/10 42/72
8,667,726 B1 * 3/2014 Huff ..... F41C 23/16 42/71.01

(Continued)

*Primary Examiner* — Derrick R Morgan
(74) *Attorney, Agent, or Firm* — J. Andrew McKinney, Jr.; McKinney & Associates, LLC.

(57) ABSTRACT

An improved firearm accessory mounting interface 200 with a durable integral mirage shield 200 that adds minimal or no weight to a weapon system, is unlikely to snag and is comfortable to hold includes a tubular handguard's cylindrical sidewall which is preferably defined with four radially spaced quadrants each having, preferably, first and second spaced arrays of parallel, elongated grooves 232, 234 separated by an external surface with at least two spaced apart transverse notches 250 which are configured to define a firearm accessory mount rail segment 260 and ergonomically comfortable grasping surface that directs hot air away from the handguard's interior and provides a plurality of mounts compatible with accessory clamps configured to engage and hold a Picatinny rail.

26 Claims, 15 Drawing Sheets

(56) References Cited

U.S. PATENT DOCUMENTS 8,739,448 B2 * 6/2014 Kimmel ..... F41C 23/16 42/124
8,806,796 B1 * 8/2014 Clifton ..... F41G 11/003 42/127
9,404,714 B2 * 8/2016 Langevin ..... F41C 23/16
9,528,793 B1 * 12/2016 Oglesby ..... F41C 23/16
9,581,403 B2 * 2/2017 Hayes ..... F41A 23/08
9,599,439 B1 * 3/2017 Sylvester ..... F41G 11/003
9,766,035 B2 * 9/2017 Storch ..... F41C 23/16
2003/0074822 A1 * 4/2003 Faifer ..... F41C 23/16 42/71.01
2004/0060222 A1 * 4/2004 Oz ..... F41G 1/35 42/146
2004/0226212 A1 * 11/2004 Shiloni ..... F41C 23/16 42/96
2005/0268513 A1 * 12/2005 Battaglia ..... F41C 23/16 42/71.01
2007/0163163 A1 * 7/2007 Munst ..... F41G 11/003 42/85
2008/0148619 A1 * 6/2008 Rogers ..... F41G 1/35 42/90
2009/0038200 A1 * 2/2009 Keng ..... F41A 23/10 42/94
2010/0307043 A1 * 12/2010 Moody ..... F41A 23/08 42/72
2011/0016762 A1 * 1/2011 Davies ..... F41A 21/487 42/75.01
2011/0185617 A1 * 8/2011 Brixius ..... F41C 23/12 42/71.01
2011/0192066 A1 * 8/2011 Kimmel ..... F41C 23/16 42/71.01
2011/0214328 A1 * 9/2011 Williams ..... F41G 11/003 42/90
2012/0017482 A1 * 1/2012 Chvala ..... F41C 23/16 42/71.01
2012/0246989 A1 * 10/2012 Troy ..... F41C 23/16 42/71.01
2013/0000174 A1 * 1/2013 Troy ..... F41A 23/10 42/72
2013/0104439 A1 * 5/2013 Hines ..... F41G 11/003 42/84
2013/0180151 A1 * 7/2013 Moore ..... F41C 27/00 42/90
2013/0326925 A1 * 12/2013 Power ..... F41C 23/16 42/71.01
2014/0013642 A1 * 1/2014 Larson, Jr. ..... F41C 23/16 42/71.01
2014/0033593 A1 * 2/2014 Moore, Jr. ..... F41C 27/00 42/90
2014/0115938 A1 * 5/2014 Jarboe ..... F41A 21/485 42/71.01
2014/0230303 A1 * 8/2014 Rice ..... F41C 27/16 42/90
2014/0259850 A1 * 9/2014 Schreckenstein ..... F41C 23/12 42/75.03
2014/0325889 A1 * 11/2014 Michal ..... F41G 11/003 42/75.01
2014/0373414 A1 * 12/2014 Nierenberg ..... F41A 3/66 42/1.06
2015/0101232 A1 * 4/2015 Schoenlau ..... F41G 11/003 42/90
2015/0168095 A1 * 6/2015 Dubreuil ..... F41C 23/16 42/90
2015/0198409 A1 * 7/2015 DeSomma ..... F41C 23/16 42/71.01
2015/0285577 A1 * 10/2015 Faifer ..... F41A 23/10 42/94
2015/0285585 A1 * 10/2015 Hewes ..... F41C 23/16 42/71.01
2015/0316347 A1 * 11/2015 Shea ..... F41C 23/16 42/75.02
2015/0345896 A1 * 12/2015 Michal ..... F41C 23/16 42/75.01
2015/0369558 A1 * 12/2015 Gottzmann ..... F41C 23/16 42/71.01
2016/0010946 A1 * 1/2016 Gibbens ..... F41C 23/16 42/71.01
2016/0054096 A1 * 2/2016 Dzwill ..... F41C 23/16 42/75.02
2016/0061548 A1 * 3/2016 Urias ..... F41A 19/10 42/69.01
2016/0076846 A1 * 3/2016 Melancon ..... F41A 23/16 42/94
2016/0209166 A1 * 7/2016 Larson, Jr. ..... F41G 11/003
2016/0273861 A1 * 9/2016 Langenbeck ..... F41A 21/24

* cited by examiner

MIL-STD-1913 Profile Specifications

1. Groove dimensions apply to all grooves. The number of grooves are dependent on application.
2. Center to center dimension applies between adjacent grooves.

Recoil Groove

FIREARM ACCESSORY MOUNTING INTERFACE, MIRAGE SHIELD AND ERGONOMIC METHOD FOR CONFIGURING RIFLE COMPONENTS AND ACCESSORIES

PRIORITY CLAIMS AND RELATED APPLICATION INFORMATION

This application is related to and claims priority to commonly owned provisional application 62/199,139, entitled "Improved Firearm Accessory Mounting Interface, Mirage Shield and Ergonomic Method for configuring rifle components and accessories", which was filed on Jul. 30, 2015, the entire disclosure of which is incorporated herein by reference. This application is also related to and claims priority to commonly owned provisional application 62/274,054, entitled "Improved, Modular T15 Precision Rifle Assembly and Method", which was filed on Dec. 31, 2015, the entire disclosure of which is also incorporated herein by reference.

BACKGROUND OF THE INVENTION

Field of the Invention

The present invention relates to rifle construction, firearm accessory mounts and more particularly relates to accessory mounts and methods for configuring a rifle with a modular structure for attaching accessories.

Discussion of the Prior Art

It is well known to those skilled in the art that firearms such as precision rifles and military rifles, e.g., M16 type rifles, are characterized by the heating of the barrels to relatively high temperatures. At such temperatures, the barrels cannot be safely held by the shooter. Consequently, a variety of forearms or handguards have been developed to surround and provide adequate cooling for the gun barrel and mitigate the possibility of burning the shooter's hands, as disclosed in U.S. Pat. Nos. 4,663,875 and 5,010,676.

With the continuing application of newly developed technologies, e.g., lasers, infrared ray scopes, micro-computerization, etc., to modern warfare, the basic combat weapon, i.e., rifles, carbines and shotguns, have become relatively complicated. This has resulted in requirements for the association of these weapons with a variety of accessories such as infrared and night vision scopes, laser spotters and the like. Use of such accessories has driven development of various types of mounting devices for rifles (see, e.g., U.S. Pat. Nos. 4,026,054, 4,733,489, 4,845,871, 5,198,600, 5,343,650 & 5,590,484).

Because firearms may be subjected to substantial abuse, plus the need for as much simplicity as possible in construction and use of the weapon, very serious requirements and restrictions are encountered in the development of militarily acceptable systems for mounting accessories to firearms. Many accessory devices used with rifles or carbines such as the M4 (e.g., 100, shown in FIG. 1A), require attaching a replacement for the traditional handguard 102. FIGS. 1B, 1C and 1D show attachment of a Knights Armament rail equipped handguard attachment 103 on an M-16 rifle 101, and this rail equipped handguard system 103 is described and illustrated in U.S. Pat. No. 5,826,363. The Knight Armaments rail adapter system illustrated in FIGS. 1B-1D has received widespread acceptance by providing a handguard system that incorporates four rail adapters to accept and support accessory devices. The rails 103 on the Knight rail adapter system (and others) are standardized mounting rails which are compatible with the Picatinny rail platform (MIL-STD-1913 or STANAG 2324), as illustrated in FIGS. 1E and 1F (which are taken from MIL-STD-1913 (AR), adopted on Feb. 3, 1995; the title of the publication is "Dimensioning Of Accessory Mounting Rail For Small Arms Weapons" and this document specified exactly what the dimensions and tolerances were for any mounting systems that were to be submitted for acceptance by the military).

The Picatinny rail (as illustrated in FIGS. 1E and 1F) has a cross-section shape roughly like a wide T with a planar top corresponding to the top (or outermost) surface of the rail. The rail has a number of evenly spaced transverse slots or grooves in the top spanning the width of the T-shaped cross-section, thus defining a plurality of inter-groove raised lugs having many exposed sharp corners and edges. The mounting rails 103 extend over the rifle handguard surrounding the rifle barrel and four distally extending rails (or "quad rails") are radially spaced at 90 degrees to provide top, bottom, left side and right side mounting options all of which extend along axes which are substantially parallel to the rifle's bore. Similar mounting rails are also configured for use on shotguns and pistols.

While quad rail handguard assemblies with mounting rails 103 have obvious utilitarian benefits, they also have shortcomings. Most notably, they can be uncomfortable or cause injury when grasped by a shooter, they can snag on clothing, barbed wire or other objects, and if equipped with handplates, hand panels or other components, they add weight and complexity to a weapon system.

Other mounting systems have detachable rails that allow the user to install rails only where they are needed, and only of the length needed. While this decreases weight (and the discomfort and other disadvantages) of having needless rails where the hand is to grip, it suffers from other disadvantages. First, such systems may be difficult or complex to install. Second, they may require custom modification of parts, such as drilling and tapping holes where needed. Third, the attachment locations may be in limited locations due to the need to relocate fasteners such as threaded inserts (or may increase cost and weight by using an excessive number of fasteners). A further significant disadvantage of systems having modular rails that may be mounted in various locations on the forearm or handguard of a rifle stock is the susceptibility to loosening. If the mount for a rifle scope becomes loose, this can cause significant aiming errors. One solution to the disadvantages of Picatinny quad rail systems is the MAGPUL™ MOE™ handguard assembly described and illustrated in Magpul's U.S. Pat. No. 8,925,236, which provides a method for attaching accessory rail segments and other items to an ergonomically shaped MOE™ brand handguard. These rails and mounting attachments, once mounted, also appear to present the susceptibility to loosening.

Another approach is the KEYMOD™ system introduced by VLTOR Weapon Systems. The KEYMOD system consists of two parts: the KEYMOD slot; and the KEYMOD nut. The slot is distinctive with a larger diameter through-hole combined with a narrow slot. The slot is chamfered on the backside while the through-hole is sized for clearance of a quick-detach sling swivel (approximately ⅜" diameter). However, the KEYMOD specifications also suffer from several disadvantages including more complex and expensive manufacturing requirements.

Precision shooters engaged in benchrest competition, Varmint hunting, military or police sniping or precision rifle match competition face additional problems relating to barrel heat management. As shots are fired, a barrel becomes increasingly hot and eventually heat rising from the barrel can cause a visible optical distortion in the shooter's view or image of the target, and this optical distortion is called "mirage." Recreational shooters such as benchrest competitors have fashioned some novel and inexpensive mirage shields from old venetian blind strips or strips of elastically stretched fabric which extend over the upper surface of the barrel's length, and these mirage shields can, if properly installed and not disturbed, reduce or eliminate optical distortions in the target image caused by heat rising from the barrel. See, for example, http://bulletin.accurateshooter-.com/2014/07/one-dollar-do-it-yourself-mirage-shield/. These shields are typically fragile and may be disturbed or stripped away altogether if carelessly handled.

Therefore, there is a need in the art for a firearm accessory mounting interface that adds minimal or no weight to a weapon system, is unlikely to snag and is comfortable to hold and which is durable and so does not require excessive care or special handling. There is also a need for a convenient, flexible, structurally rigid but ergonomically friendly and unobtrusive system and method for allowing users to attach rail-mountable accessories to a weapon such as a rifle or carbine.

OBJECTS AND SUMMARY OF THE INVENTION

Accordingly, it is an object of the present invention to overcome the above mentioned difficulties by providing a convenient, flexible, structurally rigid but ergonomically friendly and unobtrusive system and method for allowing users to attach rail-mountable accessories to a weapon such as a rifle or carbine. It is also an object of the present invention to provide an integral and durable, fuss-free mirage shield structure which mitigates optical distortion.

In accordance with the present invention, an improved mounting interface for use in a rifle handguard or the like includes a substantially tubular structure having a contoured, textured surface with plurality firearm accessory mount rail segments that are unlikely to snag anything and provides a textured external cylindrical sidewall which is comfortable to hold.

The mounting interface or tubular handguard has a proximal threaded collar segment with a proximal opening carrying internal threads configured to engage a rifles threaded receiver and provide a protective extended tubular sidewall which extends distally from the receiver to surround and protect the rifle's barrel, preferably without touching or bearing upon the rifle's barrel in any way (e.g., so that the barrel is "free floating").

The tubular handguard's cylindrical sidewall is preferably defined with four radially spaced quadrants, namely a top quadrant, a bottom quadrant, a left side quadrant and a right side quadrant. The left and right side quadrants each have, preferably, first and second spaced arrays of parallel, elongated perforating slots defined therethrough, so that the handguard's interior lumen is in fluid communication with the outside or ambient air. The cylindrical sidewall is also preferably segmented distally (e.g., along a central axis which is coaxial with the barrel's bore) into first, second and third longitudinally aligned segments of equal axial length, where the first and second segments are separated by a transverse circumferential trough or groove which encircles the sidewall at a selected length from the handguard's proximal end. The left and right side quadrant's elongated perforating slots do not extend though the circumferential troughs defining each longitudinal segment.

The cylindrical sidewall's top quadrant and bottom quadrant are preferably defined with first and second spaced arrays of parallel, elongated grooves defined therein. The elongated perforating grooves also do not extend though the circumferential troughs defining each longitudinal segment.

The tubular handguard's cylindrical sidewall thus includes, within the left and right side quadrants, a pair of elongated perforating slots or ducts which are spaced apart at a selected inter-slot width and extend for the length of each longitudinally aligned sidewall segment, from an end or circumferential trough to the next trough or to the distal end of the sidewall. The lateral sidewall segments between the first and second elongated perforating slots, define segments of a cylindrical sidewall preferably with textured sidewall surfaces, and so project radially or laterally away from the cylinder's central axis in a convex curvature defined between the first and second elongated perforating slots in the inter-slot width.

On the top and bottom quadrants, the tubular handguard's cylindrical sidewall includes a pair of elongated non-perforating grooves which are spaced apart at a selected inter-groove width and extend for the length of each longitudinally aligned sidewall segment, from an end or circumferential trough to the next trough or to the distal end of the sidewall. The sidewall segment between the spaced apart elongated grooves also defines a segment of a cylindrical sidewall, preferably with a textured sidewall surface, and so projects radially away from the cylinder's central axis in a convex curvature defined between the spaced elongated grooves in the inter-groove width.

The mounting interface of the present invention is defined with a plurality of (e.g., four) linear transverse notches defined in that sidewall's convex curvature defined between the spaced elongated grooves in the inter-groove width, and the transverse notches extend substantially from the first elongated groove to the second elongated groove and so extend substantially all the way across the inter-groove width. The linear transverse distance between the spaced apart elongated grooves (or the inter-groove width, along the transverse notches) is preferably selected to be 21.2 mm, or the same as the width of the top of a traditional Picatinny Rail segment, so accessories which are compatible with the Picatinny rail platform (MIL-STD-1913 or STANAG 2324) will easily engage and hold onto the sidewall's surface, the transverse notch surface and sidewall's elongate groove edges defining the first and second elongated non-perforating grooves, all of which cooperate to provide the enhanced, snag-free mounting interface of the present invention.

The mounting interface of the present invention is preferably configured as a forend assembly adapted for use with a service rifle (e.g., 100, 101) which is adapted for attachment to releasable picatinny-style mounts at multiple attachment locations along four quadrants while also allowing indexing of the forend assembly at multiple angular locations relative to the rifle. In a preferred embodiment, the Handguard Nut Diameter is 2.110" and the overall Handguard Diameter is 1.980"

Working now from the front toward the rear, a forend assembly consists of a forend tube with three panels, knurled to facilitate grip along the exterior surfaces, and containing a series of grooves running lengthwise, fabricated at the correct angle and width to provide a novel geometry which is comfortable to hold while also providing clamping surfaces configured to engage and support accessories designed to mount upon the popular "picatinny rails". To allow components to be attached to the forend tube via the ergonomic rail system, additional cross-slots are provided running perpendicular to center-of-bore, just scalloping the outside diameter of the forend tube, said slots having radial bottoms to provide structural strength and stability, while also maintaining desired aesthetics and an unobtrusive feel during recoil. For additional strength, each of the cylindrical knurled panel segments is separated by a continuous ring of material. Inside each knurled panel, multiple locations for attaching components, via multiple cross-slots described above, is available both lengthwise and at four different quadrants along the circumference of the forend tube.

The forend tube further comprises a rear orifice to accept a forend tube extension via an intimate mating of diameters (press fit) and further fastened by four dowel cross-pins. The forend assembly is drawn proximally and held tight against the receiver by a forend tube nut which has flange or lip that engages a flange on the tube extension upon assembly of the forend tube, the tube extension and the forend tube nut all of which may rotate freely about the common center-line of the assembly until final assembly and tightening. The forend tube nut further comprises a knurled exterior for grip and presents a threaded orifice or lumen to attach the completed forend assembly to the receiver. The forend tube extension further comprises a proximal flange surface with a plurality (e.g., four) proximally projecting tabs to be accepted in multiple slots present at the forward face of the receiver, thereby allowing the forend assembly to be easily indexed to multiple angular locations along its center-line first at increments of five degrees, then twenty two and one half degrees thereafter.

The forend tube extension further comprises a counter bore orifice to accept a forward outside diameter of a receiver barrel coupler/nut, thereby upon complete assembly to the receiver, the forend tube nut fastens the rear face of the forend tube extension's flange to the forward face of the receiver barrel coupling forend nut's internal flange, where the above described interaction provides support to the forend assembly while preventing the transfer of stress to the protruding tabs of the forend tube extension. Upon final assembly, loosening the forend tube nut just slightly allows the easy rotation and indexing of the forend assembly, while complete loosening of the forend tube nut allows complete removal of the forend assembly.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF THE PREFERRED EMBODIMENT

Turning now to FIGS. 2-9C, a structurally rigid but ergonomically friendly and unobtrusive mounting interface or forend assembly 200 and method for allowing users to attach the forend assembly to a rifle's receiver and then attach rail-mountable accessories (e.g., bipod 204) to a rifle (e.g., 202 as shown or, with modifications, 100 or 101) is illustrated.

Figure 1A:
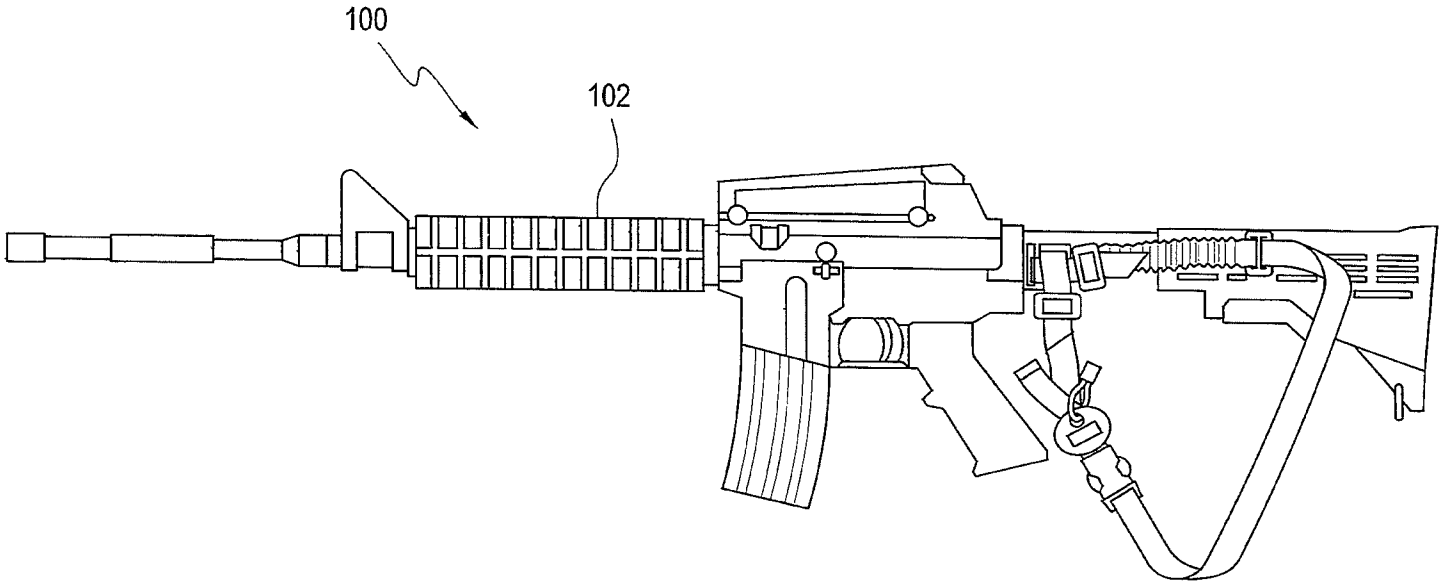
FIG. 1A PRIOR ART
FIG. 1A illustrates an M4 or CAR-15 pattern carbine or rifle with a standard substantially cylindrical forearm or handguard, as seen in the prior art.
Figure 1B:
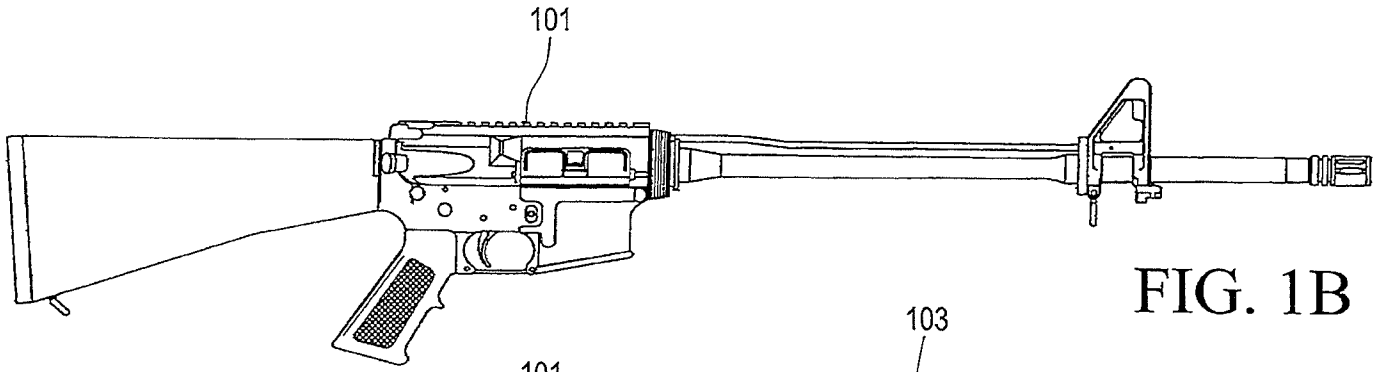
FIGS. 1B-1D illustrate an M16 pattern rifle (e.g. M110) with a standard quad-rail style forearm or handguard, as seen in the prior art.
Figure 1C:
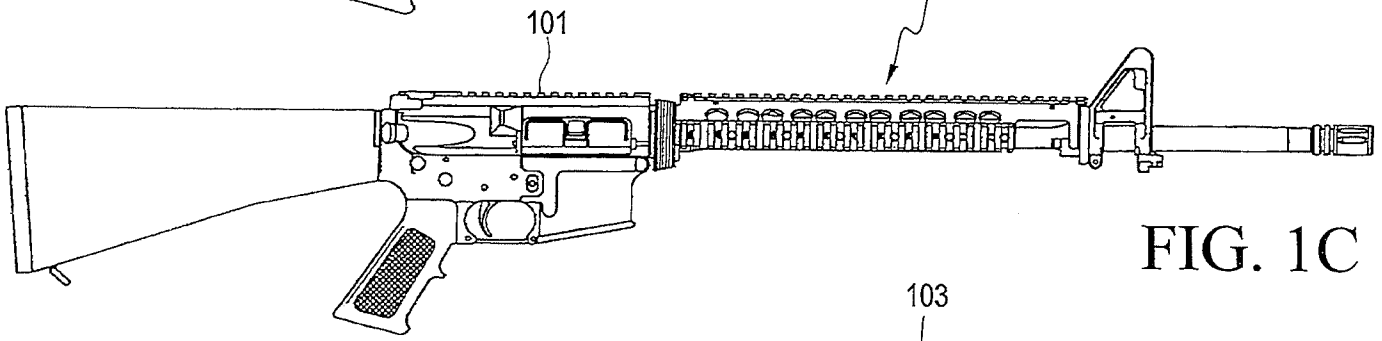
Figure 1D:
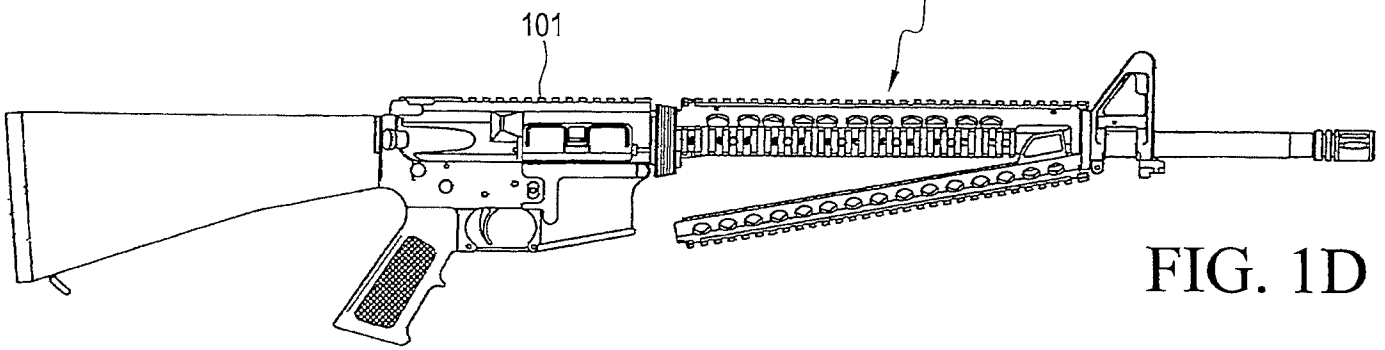
Figure 1E:
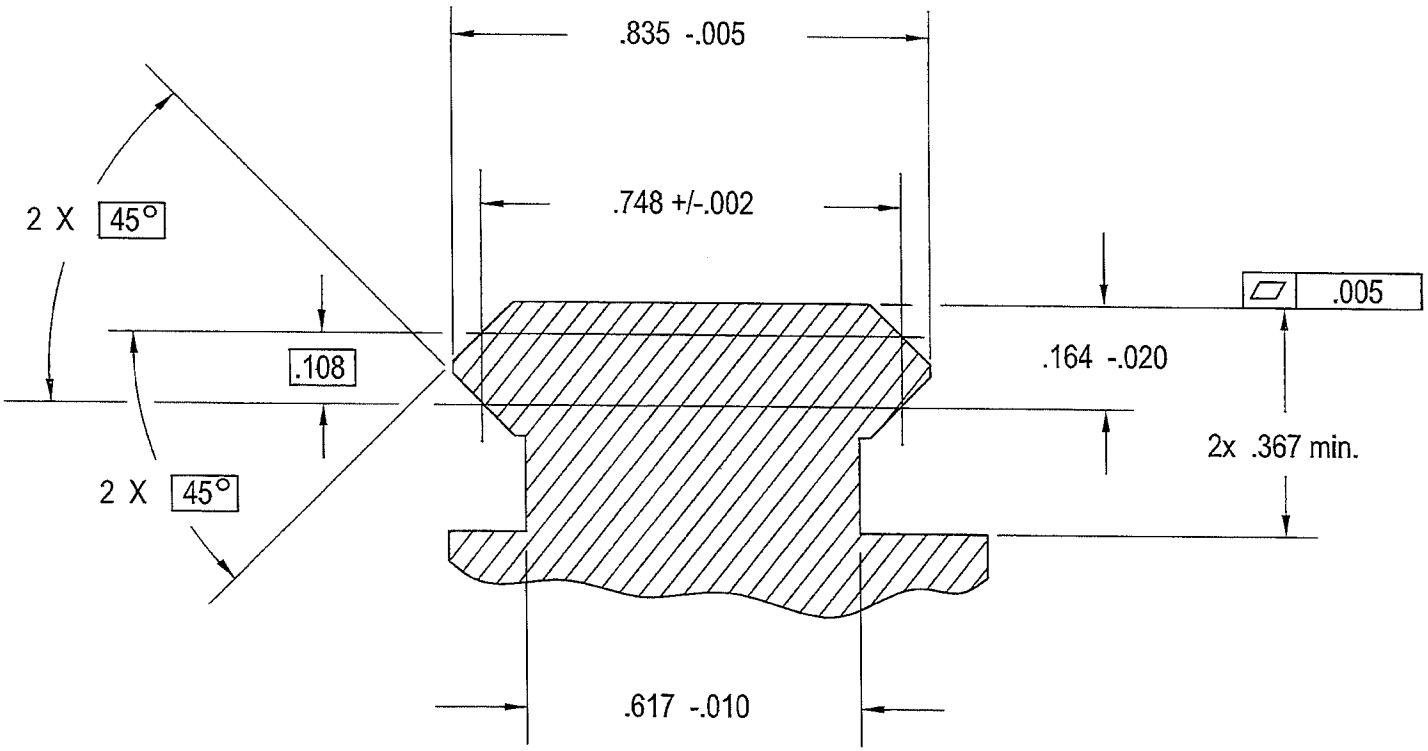
FIGS. 1E and 1F illustrate the cross sectional profile and the side view, in elevation for the MIL-STD-1913 Picatinny Rail mount incorporated in the quad rail forearm of FIGS. 1C and 1D, in accordance with the prior art.
Figure 1F:
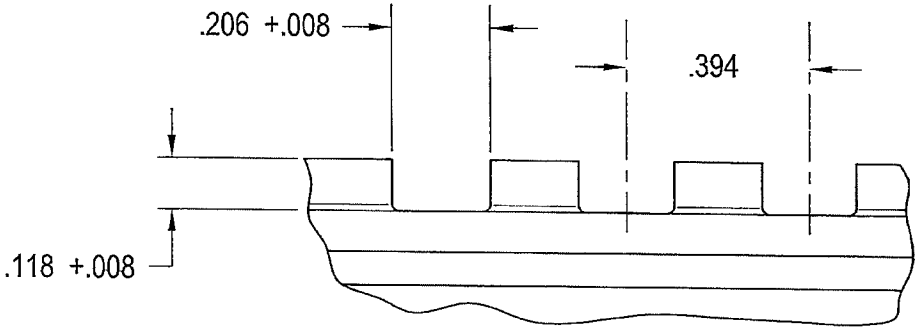
Figure 2:
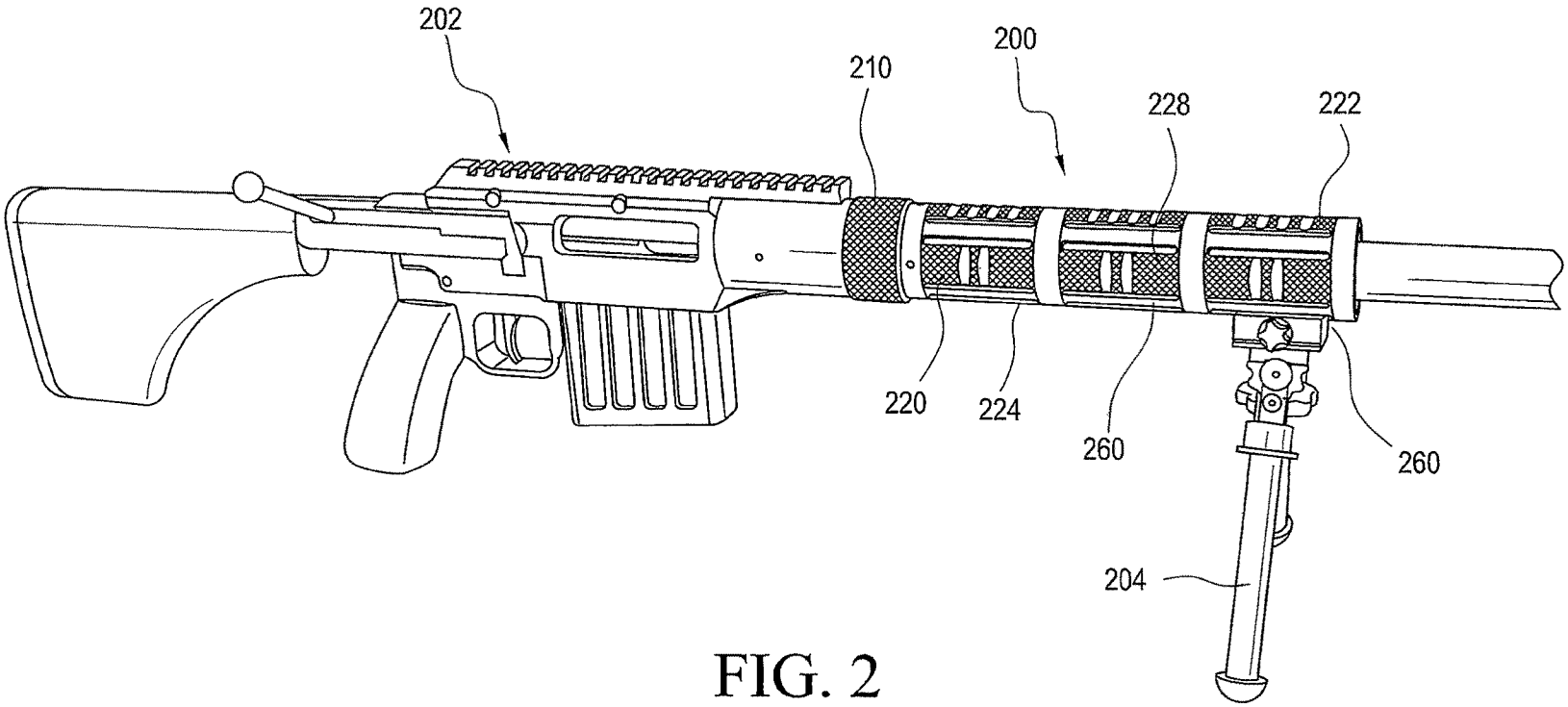
FIG. 2 illustrates a first embodiment of the enhanced accessory mount interface installed on a precision rifle and method, in accordance with the present invention.

In accordance with the present invention, an improved mounting interface 200 for use in a rifle handguard or the like includes a substantially tubular structure having a contoured, textured exterior surface with a plurality of firearm accessory mount rail segments 260 that are configured to receive bipods and other accessories adapted to clamp to a standard Picatinny rail, but in a configuration which omits a typical Picatinny rail's projecting corners (or 'horns') so those rail segments are unlikely to snag anything. Instead, the enhanced accessory mount interface or forend assembly 200 provides a textured external cylindrical sidewall which is much more comfortable to hold than the quad-rail forend assembly 103 of the prior art (as shown in FIGS. 1C and 1D.

In the exemplary embodiment illustrated in FIGS. 2-9B, mounting interface or tubular handguard 200 has a proximal threaded collar segment 210 with a proximal opening carrying internal threads configured to engage a rifle's threaded receiver 212 and provide a protective extended tubular sidewall which extends distally from the receiver 212 to surround and protect the rifle's barrel 214, preferably without touching or bearing upon the rifle's barrel 214 in any way (e.g., so that barrel 214 is "free floating"). For purposes of nomenclature "proximal" will refer to the near side or end, nearer the receiver 212 and "distal" will refer to the far side or end, closer to the muzzle end of barrel 214.

Figure 3:
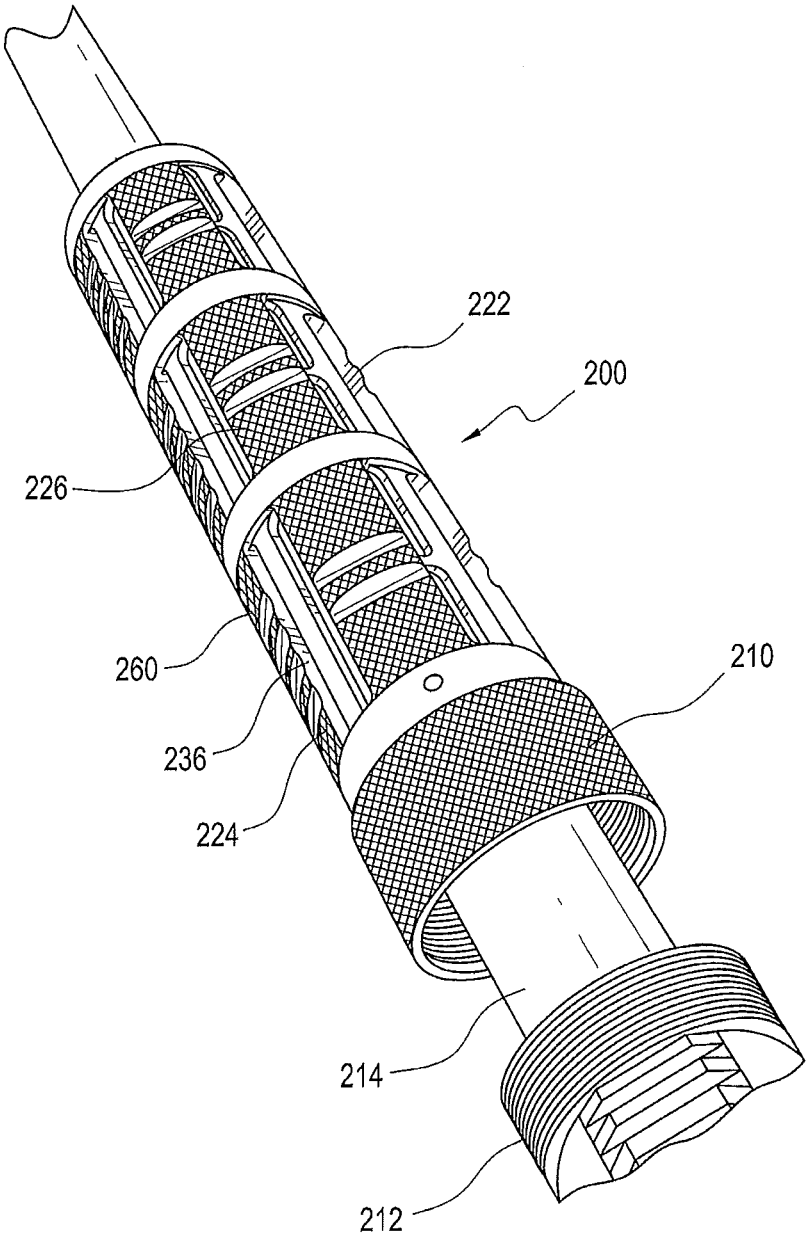
FIG. 3 illustrates the enhanced accessory mount interface of FIG. 2, partially assembled, in accordance with the present invention.
Figure 4:
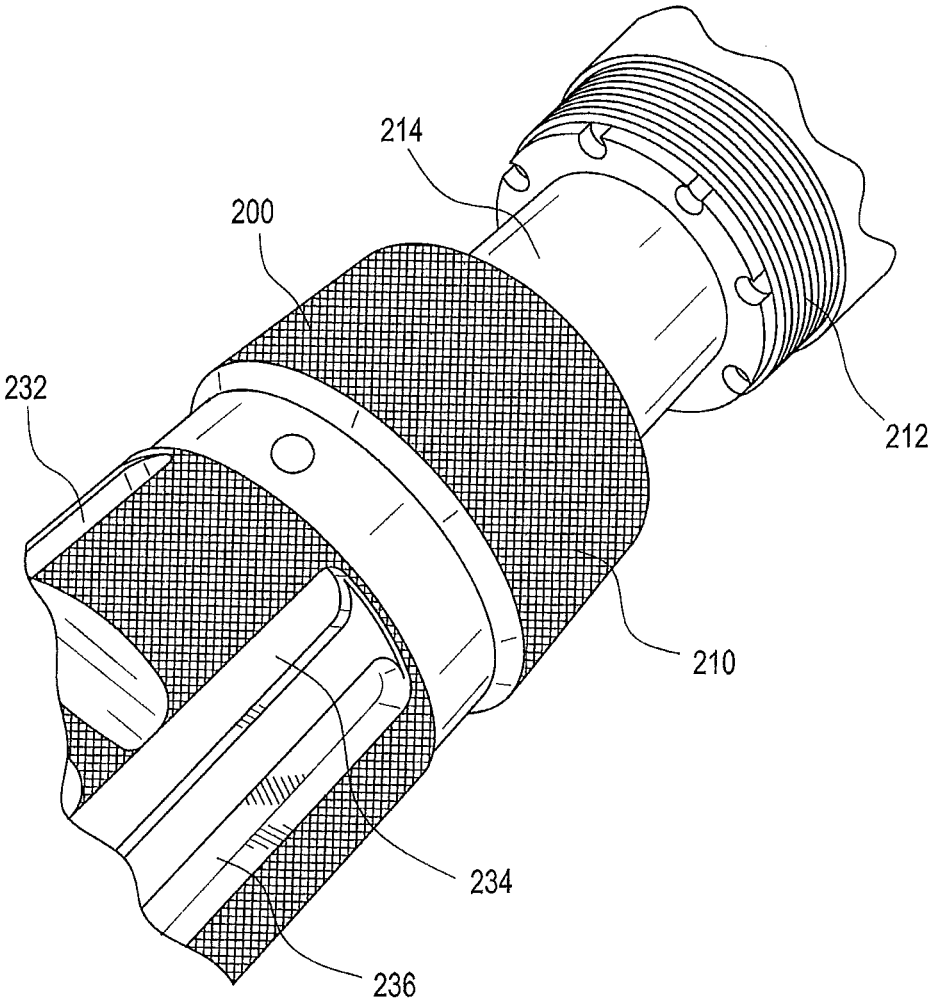
FIG. 4 illustrates another view of the enhanced accessory mount interface and method of FIGS. 2 and 3, in accordance with the present invention.
Figure 5:
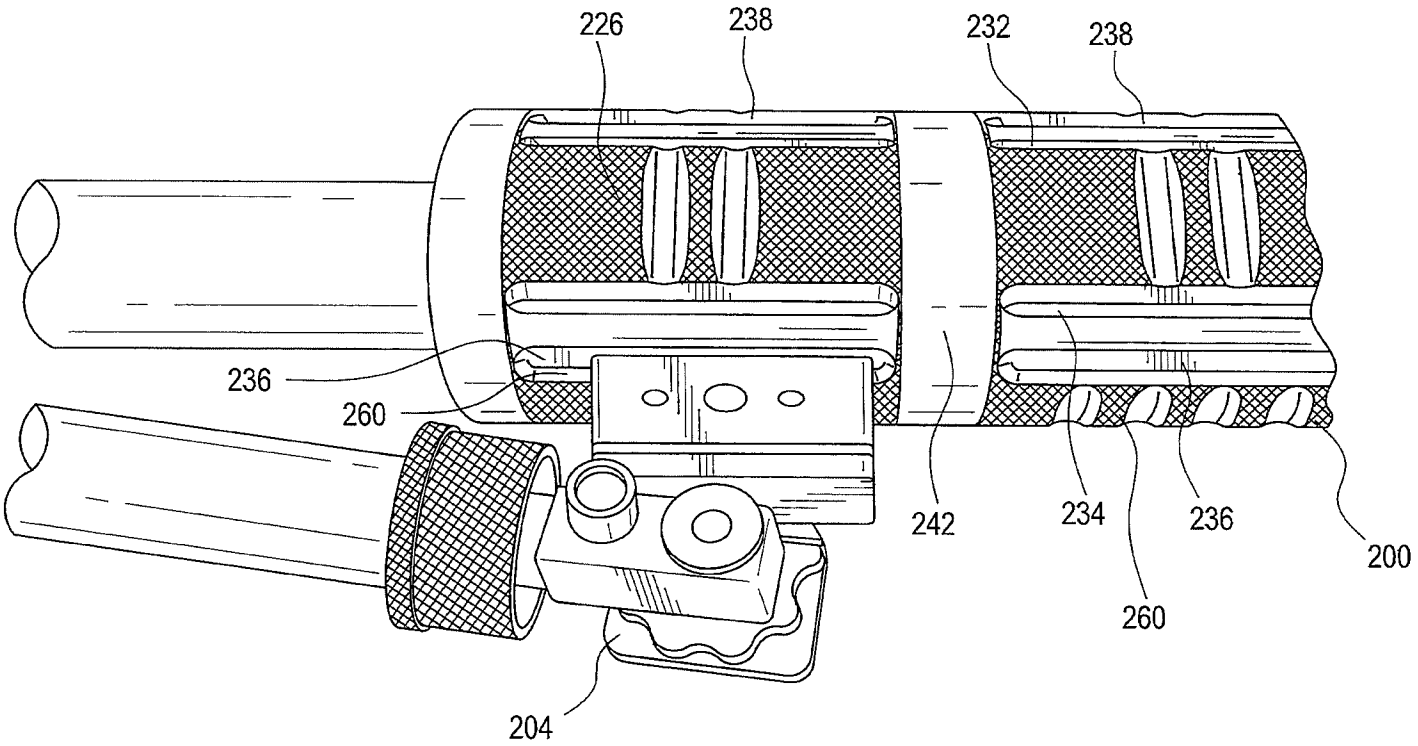
FIG. 5 illustrates a detailed view of the distal end of the enhanced accessory mount interface and method of FIGS. 2-4, in accordance with the present invention.

Proximal threaded collar segment 210 preferably has a knurled external sidewall and internal threads which are configured to engage and hold the distal-end external threads of receiver 212 (as best seen in FIG. 3). Collar 210 has an open proximal lumen defined in the proximal end which defines an annular proximal end wall which is tightened against a corresponding annular abutment surface defined in receiver 212, when collar 210 is affixed thereupon. Collar 210 has a distal segment of slightly reduced diameter which fits snuggle within the open proximal end of and engages the elongated forend tube member. As will be described in greater detail with regard to FIGS. 6, 7, and 8, below, forend tube assembly 200 preferably comprised three coaxially aligned tubular segments where collar segment 210 includes a forend tube nut (with the external knurled sidewall surface) which receives and supports a flanged forend tube extension having a proximal flange that bears on the receiver's distal transverse abutment surface.

The tubular handguard's cylindrical sidewall 220 is preferably defined with four radially spaced quadrants, namely a top quadrant 222, a bottom quadrant 224, a left side quadrant 226 and a right side quadrant 228. The left and right side quadrants 226, 228 each have, preferably, first and second spaced arrays of parallel, elongated perforating slots or ducts 232, 234 defined therethrough, so that the handguard's interior lumen is in fluid communication with the outside or ambient air. The elongated perforating slots or ducts 232, 234 are preferably configured to aim flowing barrel-heated air from the interior of the handguard lumen laterally and away from the top quadrant 222, thereby reducing the potential for optical distortion in the target image seen by the shooter and providing an integral and durable, fuss-free mirage shield structure which mitigates hot barrel induced optical distortion for the precision shooter and the corresponding target image stability issues seen by the shooter as the barrel heats up.

The cylindrical sidewall 220 is also preferably segmented into first, second and third longitudinally aligned segments of equal length, where the first and second segments are separated by a transverse circumferential trough or groove 242 which encircles the sidewall at a selected length from the handguard's proximal end. The elongated perforating slots or ducts 232, 234 do not extend though the circumferential troughs which separate (or are between) each longitudinal segment.

The cylindrical sidewall's top quadrant 222 and bottom quadrant 224 have first and second spaced arrays of parallel, elongated grooves 236, 238 defined therein. The cylindrical sidewall's transverse circumferential troughs which encircle the sidewall separate each segment so that the elongated grooves 236, 238 do not extend though the circumferential troughs defining each longitudinal segment.

The tubular handguard's cylindrical sidewall thus includes, within the left and right side quadrants 226, 228, a pair of elongated perforating slots or ducts 232, 234 which are spaced apart at a selected inter-slot width and extend for the length of each longitudinally aligned sidewall segment, from an end or circumferential trough to the next trough or to the distal end of the sidewall. The lateral sidewall segments between the first and second elongated perforating slots remain segments of a cylindrical sidewall, preferably with textured sidewall surfaces, and so project radially or laterally away from the cylinder's central axis in a convex curvature defined between the first and second elongated perforating slots 232, 234 in a segment of the sidewall referred to as the inter-slot width.

On the top and bottom quadrants 222, 224 the cylindrical sidewall's pair of spaced apart parallel elongated non-perforating grooves 236, 238 are spaced apart at a selected inter-groove width and extend for the length of each longitudinally aligned sidewall segment, from an end or circumferential trough to the next trough or to the distal end of the sidewall. The sidewall segment between the spaced apart elongated grooves also defines a segment of a cylindrical sidewall, preferably with a textured sidewall surface, and so projects radially away from the cylinder's central axis in a convex curvature defined between the first and second elongated grooves 236, 238 in a segment of the side wall referred to as the inter-groove width.

The mounting interface of the present invention is defined with a plurality of (e.g., four) linear transverse notches 250 defined in that sidewall's convex curvature defined between the first and second elongated grooves 236, 238 in the inter-groove width, and the transverse notches 250 extend substantially from said first elongated groove 236 to said second elongated groove 238 and so extend substantially all the way across the inter-groove width. The linear transverse distance between the first and second elongated grooves (or the inter-groove width, along the transverse notches 250) is preferably selected to be 21.2 mm, or the same as the width of the top of a traditional Picatinny Rail segment, so accessories which are compatible with the Picatinny rail platform (MIL-STD-1913 or STANAG 2324) will easily engage and hold onto the sidewall's surface, the transverse notch surface and sidewall's elongate groove edges defining the first and second elongated non-perforating grooves 236, 238, all of which cooperate to provide a firearm accessory mount rail segment 260. In the illustrated embodiment, the top quadrant and bottom quadrant each provide three firearm accessory mount rail segments 260 for the enhanced, snag-free mounting interface 200 of the present invention.

In the first embodiment illustrated in FIGS. 2-5, the tubular interface or handguard 200 defines three longitudinally aligned sidewall segments separated by two circumferential grooves 242, and persons of skill in the art will appreciate that alternative embodiments may have more or fewer segments and more or fewer accessory mount rail segments 260.

Figure 6:
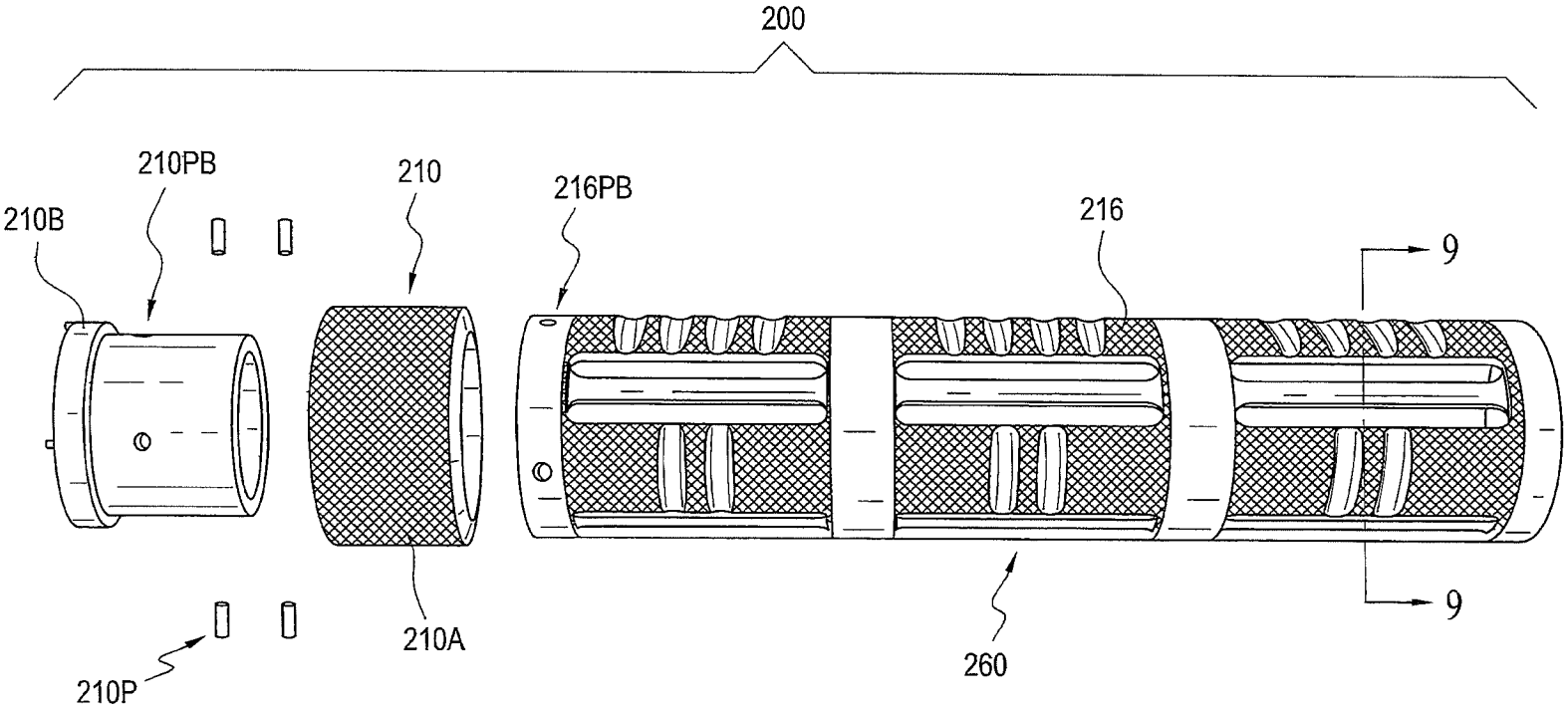
FIG. 6 illustrates the components of the forend tube assembly of the enhanced accessory mount interface of FIGS. 2-5, in accordance with the present invention.
Figure 7:
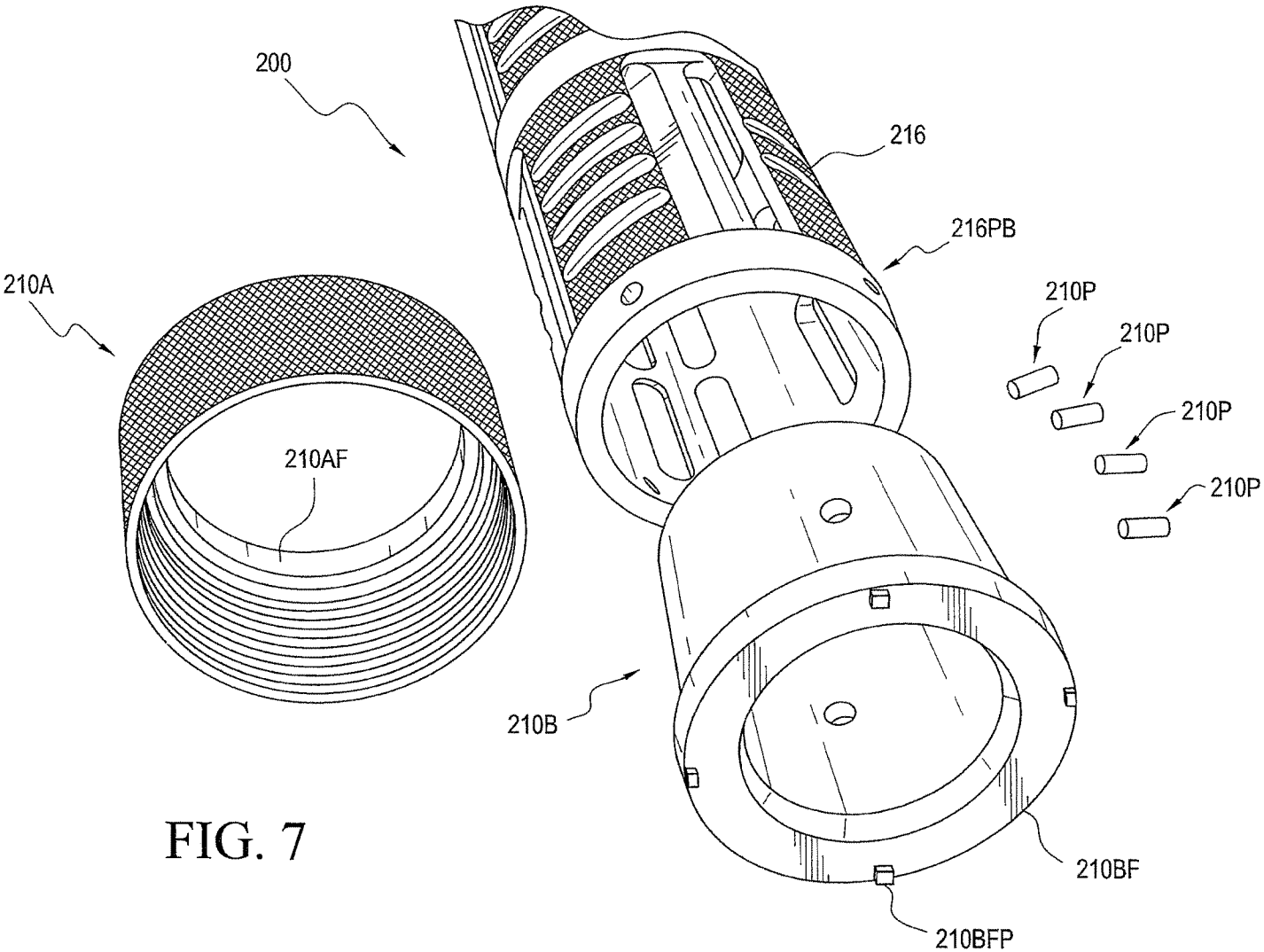
FIG. 7 is a proximal end view illustrating the forend tube assembly of the enhanced accessory mount interface of FIG. 6, in accordance with the present invention.
Figure 8:
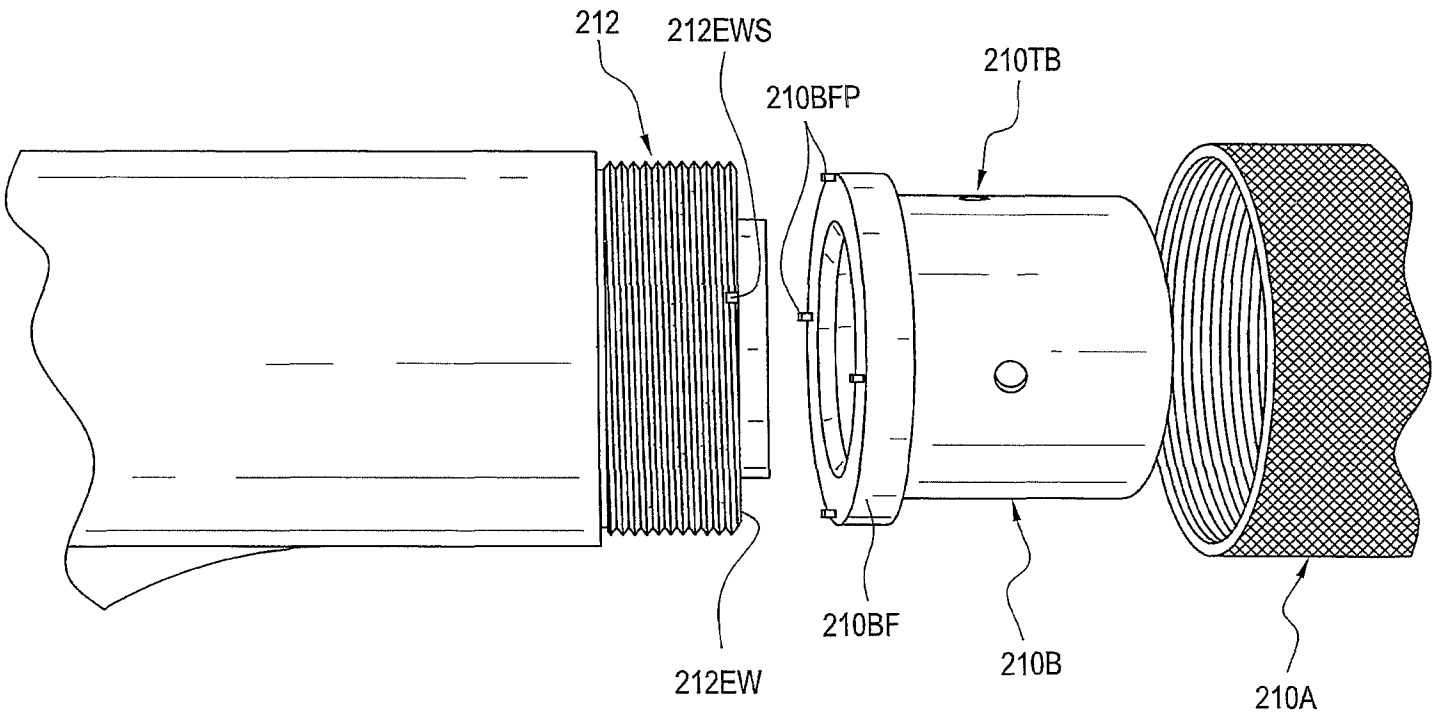
FIG. 8 is a right side view, in elevation, illustrating the forend tube assembly of the enhanced accessory mount interface of FIGS. 6 and 7 and the method for aligning and indexing the forend tube extension and forend tube nut, in accordance with the method of the present invention.

Turning now to FIGS. 6, 7 and 8, the forend tube assembly or mounting interface assembly 200 is shown disassembled into three coaxially aligned components, including the main forend tube member 216 defining cylindrical sidewall 220, and proximal threaded collar segment 210 which comprises forend tube nut 210A and forend tube extension 210B. As noted above, forend tube nut 210A preferably has a knurled external sidewall and internal threads which are configured to engage and hold the distal-end external threads of receiver 212 (as best seen in FIG. 3).

Forend tube nut 210A has a cylindrical sidewall having an open proximal lumen with proximal end which defines an annular proximal end wall which is tightened proximally, where it may be limited in proximal engagement by a corresponding annular abutment surface defined in receiver 212, when forend tube nut 210A 210 is affixed thereupon. Forend tube nut 210A also has in its internal lumen an inwardly projecting annular flange 210AF at its distal end, and inwardly projecting tube nut flange 210AF is dimensioned to engage a draw tight against the tube extension's proximal flange 210BF when tube nut 210A is threadably engaged upon and tightened proximally onto receiver 212.

Prior to assembly and installation, the rifle's barrel 214 (shown in FIG. 3, but not FIG. 8) is aligned with the distal end of receiver 212 and then the components of forend assembly 200 are aligned coaxially with the barrel 214. Forend tube extension 210B is aligned with and placed in abutment against a distal endwall surface 212EW of receiver 212 and preferably tube extension 210B is radially aligned by placing one or more tube extension flange indexing pins 210BFP into one or more receiver endwall slots 212EWS which then indexes the radial or angular orientation of forend tube extension 210B (and thus the entire forend assembly 200) on the rifle's receiver 212.

Collar assembly 210 includes forend tube nut 210A which engages and supports forend tube extension 210B which defines the distally projecting segment of slightly reduced diameter cylindrical sidewall which fits snuggly within the open proximal end of and engages the elongated forend tube member. Tube extension 210B is affixed to forend tube member 216 by installation of a plurality of (e.g., four) transverse dowel pins 210P which are received in radially arrayed transverse bores (210TB, 216TB) defined in the cylindrical sidewall of said tube extension 210B and in the sidewall of tubular member 216, where the tubular member's bores 216TB are defined in sidewall 222 near its proximal end (best seen in FIG. 6).

So forend tube assembly 200 preferably comprises three coaxially aligned tubular segments where collar segment 210 includes a forend tube nut 210A (with the external knurled sidewall surface) which receives and supports flanged forend tube extension 210B having proximal flange 210BF that bears on the receiver's distal transverse abutment end wall surface 212EW.

Figure 9A:
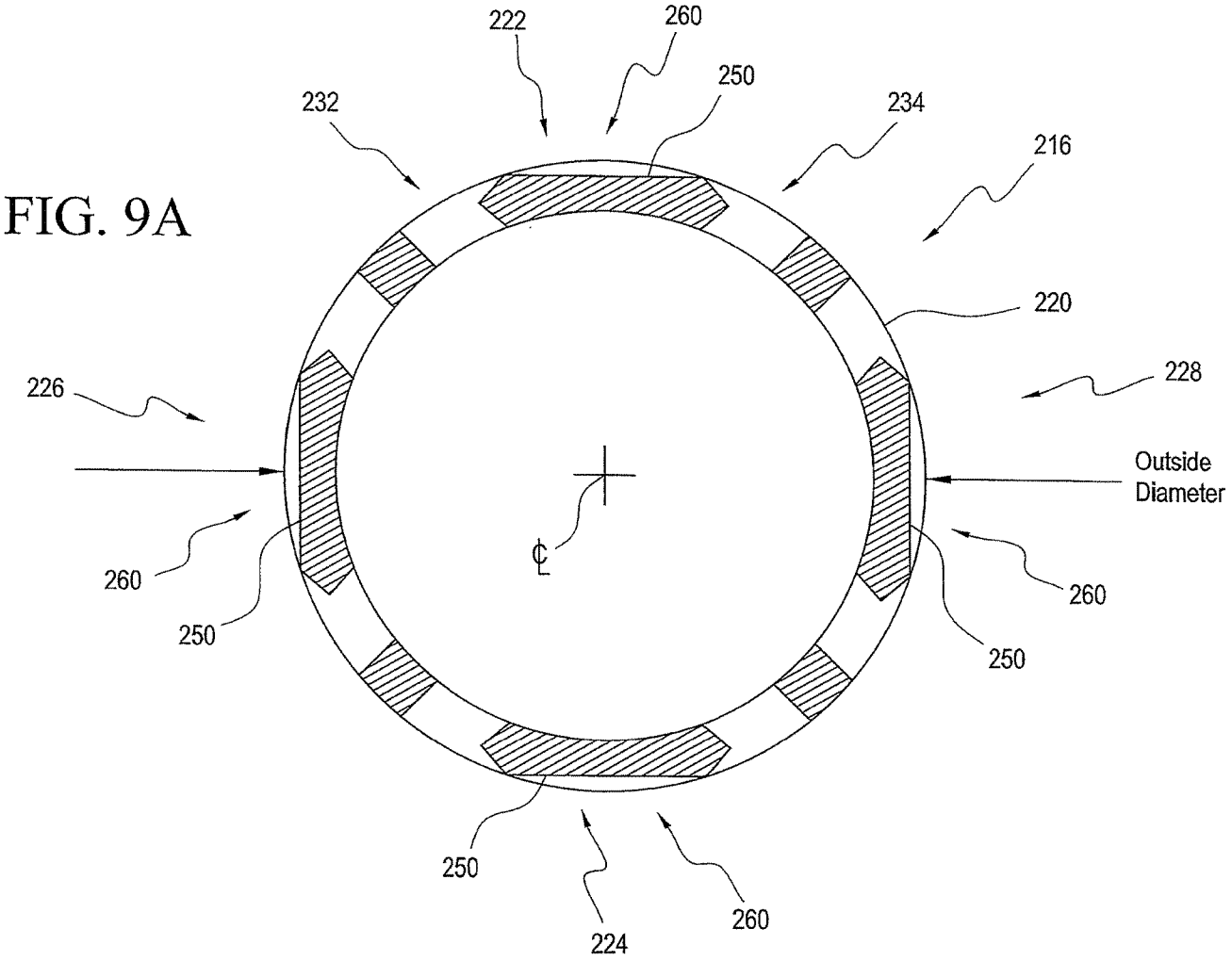
FIG. 9A is a cross sectional view in elevation of the forend tube extension of the enhanced accessory mount interface of FIGS. 6 and 7, taken along a transverse plane "9-9", illustrating the snag-free outer contours, in accordance with the present invention.
Figure 9B:
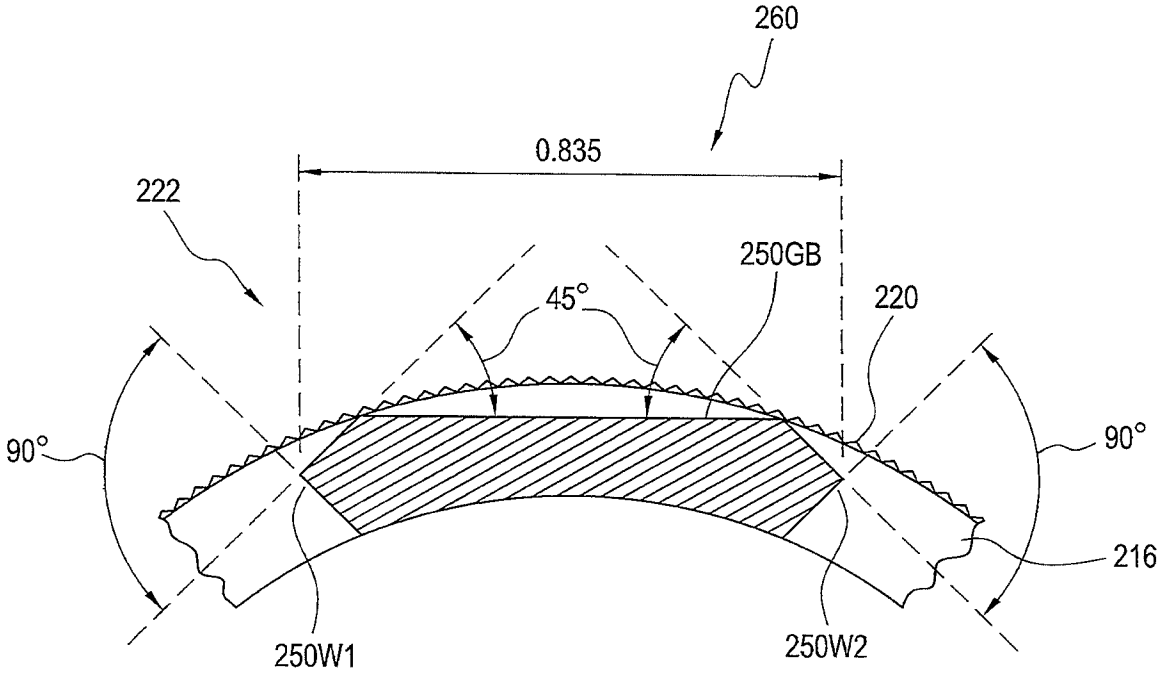
FIG. 9B is an enlarged cross section in elevation providing a more detailed profile view of one of the ergonomically contoured, snag-free rail-mount sections illustrated in FIG. 9A, in accordance with the present invention.
Figure 9C:
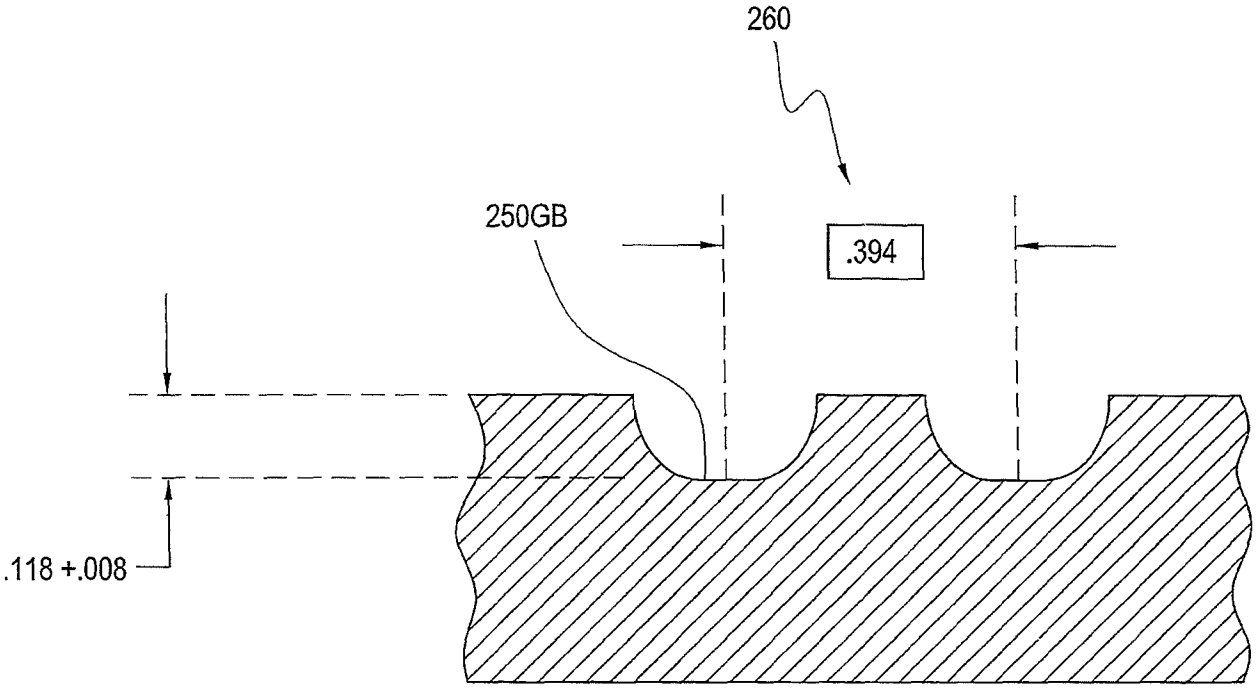
FIG. 9C is a side view, in elevation, illustrating the geometry of the ergonomic rail mount of FIGS. 6, 9A and 9*b*, as configured to receive an accessory configured with a clamp to engage a MIL-STD-1913 Picatinny Rail mount, in accordance with the present invention.
Figure 10:
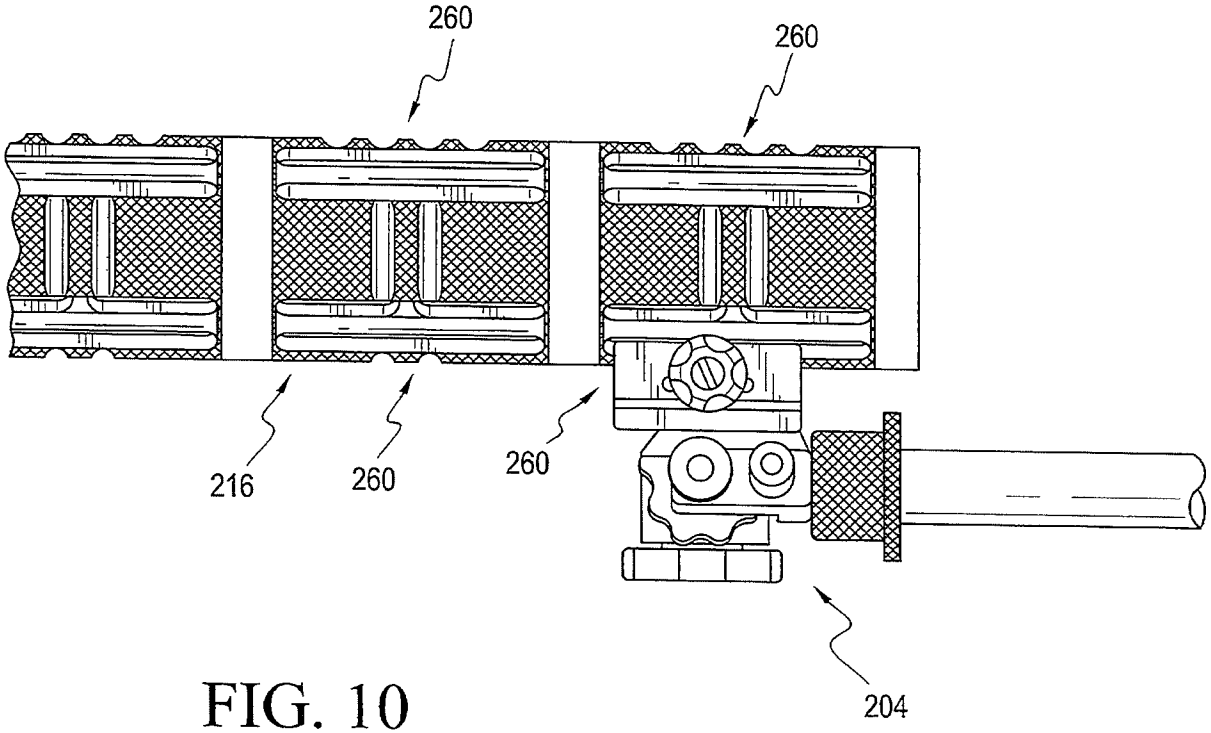
FIG. 10 is a right side view, in elevation, illustrating the forend tube of the enhanced accessory mount interface of FIGS. 2-9C and the method for aligning and attaching a rail-mountable clamping accessory, in accordance with the present invention.

Turning now to FIGS. 9A, 9B and 9C, FIG. 9A is a cross sectional view in elevation of forend tube extension 216 of the enhanced accessory mount interface 200 of FIGS. 6 and 7, taken along a transverse plane "9-9", illustrating the snag-free outer contours of the ergonomic rail mounts 260 defined in the external wall sections of tube extension 216. FIG. 9B is an enlarged cross section in elevation providing a more detailed profile view of one of the ergonomically contoured, snag-free rail-mount sections 260, and it is illustrated that each ergonomic mount section 260 is formed of at least first and second transversely aligned, parallel rounded notches 250, each shaped as troughs or radiussed grooves having a substantially linear groove bottom 250GB which is bounded by angled wall segments. In the exemplary embodiment shown in FIG. 9B, it is shown that the angle between the horizontal groove bottom surface 250GB and the angled wall segments at opposing ends is 45 degrees. The ergonomic mount 260 thus defines an integral sunken rail segment having notches 250 terminating in angled wall segments which terminate laterally at opposing ends to define a rail segment width of 0.835 inches. The lateral ends of each rail segment notch 250 are configured as outside corner surfaces or laterally opposed wedge-shaped surfaces 250W1, 250W2 comprising the angled wall segment which angles down from the notch bottom 250GB and terminates in a perpendicular, short surface which intersects therewith and provides an outside corner like rebated wall segment which intersects the outwardly facing angled wall segment at, preferably, 90 degrees (as seen in FIG. 9B). With this configuration, the opposing outside corner defining clamping surfaces 250W1, 250W2 of ergonomic mount 260 are within or inside of the outer circumferential surface 220 of forend tube 216, which preferably has an outside diameter of approximately 2 inches and is knurled or textured, to provide a comfortable but secure gripping surface.

As best seen in FIG. 6, mounting interface 200 is defined with a plurality of (e.g., two or four) linear transverse notches 250 defined in that sidewall's convex curvature defined between the spaced elongated grooves (232, 234) in the inter-groove width, and the transverse notches 250 extend substantially from the first elongated groove 232 to the second elongated groove 234 and so extend substantially all the way across the inter-groove width. The linear transverse distance between the spaced apart elongated ducting cooling grooves (or the inter-groove width, along the transverse notches 250) is preferably selected to be 21.2 mm or 0.835 inches (e.g., the same as the width of the top of a traditional Picatinny Rail segment), so accessories which are compatible with the Picatinny rail platform (MIL-STD-1913 or STANAG 2324) will easily engage and hold onto the forend assembly's sidewall's surface, where the transverse notch 250 and the sidewall's elongate groove edges define the first and second elongated non-perforating grooves, all of which cooperate to provide the enhanced, snag-free mounting interface of the present invention.

The mounting interface of the present invention is preferably configured as a forend assembly adapted for use with a precision rifle (e.g., 202) or a service rifle (e.g., 100, 101) which is adapted for attachment to releasable picatinny-style mounts at multiple attachment locations along four quadrants while also allowing indexing of the forend assembly at multiple angular locations relative to the rifle. In a preferred embodiment, the Handguard Nut Diameter is 2.110" and the overall Handguard Diameter is 1.980".

Another feature of the ergonomic mount 260 of the present invention is that each transverse mounting notch 250 has a cross sectional shape which is rounded or radiussed, as best seen in FIG. 9C. FIG. 9C is a side view, in cross section and elevation, illustrating the geometry of the transverse notches 250 of ergonomic rail mount 260 as also seen in FIGS. 6, 9A, 9B and 10, as configured to receive an accessory (e.g., bipod assembly 204) configured with a clamp to and engage a MIL-STD-1913 Picatinny Rail mount, but here clamping inwardly against and compressing while engaging the opposing mount notch opposing edge surfaces 250W1, 250W2.

Having described and illustrated preferred embodiments of a new and improved firearm accessory mounting interface, mirage shield and ergonomic method for configuring rifle components and accessories, it is believed that other modifications, variations and changes will be suggested to those skilled in the art in view of the teachings set forth herein. It is therefore to be understood that all such variations, modifications and changes are believed to fall within the scope of the claims appended hereto.

I claim:

1. A firearm accessory mounting interface, comprising:

a tubular handguard having a cylindrical outer sidewall with an external sidewall surface defined around a central axis, said external sidewall surface defining an external convex curvature having first and second spaced parallel arrays of longitudinal elongated grooves, slots or defined therethrough to provide fluid communication between an interior lumen within said cylindrical sidewall and ambient air;

said external sidewall surface including an impermeable first quadrant surface between said first and second spaced arrays of longitudinal elongated slots; and said first quadrant surface including a plurality of spaced transverse notches which are defined transversely across, but not through said first quadrant surface;

wherein said first quadrant surface and transverse notches define a mount which provides edges and grasping surfaces sunken within the outside diameter of said external sidewall's substantially circular cross section, wherein said mount and said transverse notches are dimensioned to engage and support rail-mountable accessories.

2. The accessory mounting interface of claim 1, wherein said cylindrical sidewall's convex curvature is defined between the first and second elongated slots in an inter-slot width wherein said inter-slot width is coextensive with said first quadrant external sidewall surface to provide an integral mount thereon.

3. The accessory mounting interface of claim 2, wherein said longitudinal slots are configured to aim flowing barrel-heated air from the interior of the handguard lumen laterally and away from a top quadrant, thereby reducing the potential for optical distortion in a target image seen by the shooter and providing an integral and durable mirage shield structure which mitigates optical distortion as the barrel heats up.

4. The accessory mounting interface of claim 2, wherein said longitudinal slots are spaced apart with a spacing of approximately 21.2 mm and said plurality of spaced transverse notches are approximately 21.2 mm long to define a firearm accessory mount rail segment so that rail-mountable accessories may be attached thereto in a manner compatible with accessories configured to engage and hold a Picatinny rail.

5. The accessory mounting interface of claim 2, wherein said longitudinal slots define opposing side surfaces of said inter-slot width in which are defined said plurality of spaced transverse notches which are each approximately 21.2 mm or 0.835 inches long to define a snag-free sunken firearm accessory mount rail segment, so that rail-mountable accessories may be removably clamped and attached thereto.

6. An Ergonomic Method for configuring rifle components and accessories, comprising:

(a) providing a tubular handguard having a cylindrical sidewall which is defined with an external surface having an outside diameter and, first and second spaced arrays of parallel, elongated slots: said sidewall surface between said slots having a plurality of spaced transverse notches, wherein said sidewall surface between said slots is configured within said outside diameter to define a sunken rail segment and ergonomically comfortable grasping surfaces that are configured to receive accessory clamps configured to engage and hold a Picatinny rail;

(b) providing, on said handguard's sidewall surface between said slots a convex curvature defined between the first and second elongated slots non perforating grooves in-an inter-groove width; and (c) providing a firearm accessory such as a bipod with a releasable mount configured to engage and hold a Picatinny rail with one, two or three transverse pins dimensioned to engage one, two or three Picatinny rail transverse grooves.

7. The Ergonomic Method for configuring rifle components and accessories of claim 6, further comprising:

configuring said elongated perforating slots or ducts to aim flowing barrel-heated air from the interior of the handguard lumen laterally and away from a top quadrant, thereby reducing the potential for optical distortion in the target image seen by the shooter and providing an integral and durable, fuss-free mirage shield structure which mitigates such optical distortion for the precision shooter as the barrel heats up.

8. A rifle forend assembly configured for attachment to a rifle's receiver, comprising:

a forend with an external wall surface having an external wall surface outside diameter and providing an enhanced accessory mount interface with a plurality of sunken snag-free ergonomic rail mounts defined within outer contours of the external wall surface;

wherein each sunken rail-mount has at least first and second transversely aligned, parallel rounded notches, each shaped as a trough or radiussed groove having a substantially linear groove bottom which is bounded by angled wall segments, and the angle between the horizontal groove bottom surface and the angled wall segments at opposing ends is 45 degrees;

wherein each sunken rail mount thus defines an integral sunken rail segment having spaced notches terminating in angled wall segments which terminate laterally at opposing ends to define a rail segment width of 0.835 inches, and wherein the lateral ends of each rail segment notch 250 are configured as outside corner surfaces or laterally opposed wedge-shaped surfaces which each define an outside corner like rebated wall segment which intersects the outwardly facing angled wall segment at 90 degrees.

9. The rifle forend assembly of claim 8, wherein said sunken rail segment opposing outside corner defining clamping surfaces are within or inside of the outer circumferential surface of the forend's outer surface.

10. The rifle forend assembly of claim 9, wherein said forend's outer surface has an outside diameter of approximately two inches and is knurled or textured, to provide a comfortable but secure gripping surface.

11. The rifle forend assembly of claim 9, wherein said mounting interface notches are defined in said sidewall outer surface which is tubular, and wherein said notches are defined between and bounded by first and second spaced elongated grooves in the inter-groove width, and the transverse notches extend substantially from the first elongated groove to the second elongated groove and so extend substantially all the way across the inter-groove width.

12. The rifle forend assembly of claim 11, wherein the linear transverse distance between the spaced elongated grooves is 21.2 mm or 0.835 inches, so accessories which are compatible with the Picatinny rail platform (MIL-STD-1913 or STANAG 2324) will easily engage and hold onto the forend assembly's sidewall's surface, where the transverse notch 250 and the sidewall's elongate groove edges define the first and second elongated non-perforating grooves, all of which cooperate to provide an enhanced, snag-free mounting interface.

13. The rifle forend assembly of claim 9, wherein said mounting interface is configured as a forend assembly adapted for use with a rifle and is adapted for attachment to releasable Picatinny-style mounts at multiple attachment locations along four quadrants while also allowing indexing of the forend assembly at multiple angular locations relative to the rifle.

14. The rifle forend assembly of claim 9, wherein each of the transverse mounting notches has a cross sectional shape which is rounded or radiussed, and said mount provides a snag free surface which is configured to receive an accessory with a clamp to engage a MIL-STD-1913 Picatinny Rail mount, clamping inwardly against and compressing while engaging the opposing notch edge surfaces.

15. The rifle forend assembly of claim 11, wherein said first and second spaced elongated grooves defined in said sidewall's outer surface comprise first and second slots which provide fluid communication between an interior lumen and ambient air.

16. The rifle forend assembly of claim 15, wherein said first and second slots are configured to aim barrel-heated air from the interior lumen laterally and away from a top surface of the forend sidewall, thereby reducing the potential for optical distortion in a target image seen by the shooter and providing an integral and durable mirage shield which mitigates optical distortion.

17. The rifle forend assembly of claim 8, further including a coaxially aligned proximal threaded collar segment which comprises forend tube nut and forend tube extension;

wherein said forend tube nut has a knurled external sidewall and internal threads which are configured to engage and hold distal-end external threads of a rifle receiver;

wherein forend tube nut has a cylindrical sidewall having an open proximal lumen with proximal end which defines an annular proximal end wall which is configured to be tightened proximally, where it may be limited in proximal engagement by a corresponding annular abutment surface defined in the rifle receiver when the forend tube nut is affixed thereupon.

18. The rifle forend assembly of claim 17, wherein said forend tube nut also has in its internal lumen an inwardly projecting annular flange at a distal end;

wherein the inwardly projecting tube nut flange is dimensioned to engage and draw tight against a corresponding proximal flange in the tube extension when the tube nut is threadably engaged upon and tightened proximally onto the rifle's receiver.

19. The rifle forend assembly of claim 18, wherein said forend assembly, including said forend tube extension are configured to be aligned with the distal end of a rifle's receiver and a rifle's barrel such that said Forend tube extension may be aligned with and placed in abutment against a distal endwall surface of the rifle's receiver and the tube extension carries one or more tube extension flange indexing pins which are configured for insertion into one or more receiver endwall slots which may then index the radial or angular orientation of forend tube extension and thus the entire forend assembly on the rifle's receiver.

20. The rifle forend assembly of claim 19, wherein said Collar assembly includes forend tube nut which is configured to engage and support the forend tube extension to define a distally projecting segment of slightly reduced diameter cylindrical sidewall which may fit snuggly within an open proximal end of and engage the forend tube member; and the tube extension is configured to be affixed to the forend tube member by installation of a plurality of transverse dowel pins which are received in radially arrayed transverse bores defined in the cylindrical sidewall of said tube extension and in the sidewall of the tubular member where the tubular member's bores are defined in the sidewall near its proximal end.

21. A rifle forend assembly configured for attachment to a rifle's receiver, comprising:

a forend with an external wall surface providing an enhanced accessory mount interface having a plurality of sunken ergonomic rail mount sections with snag-free outer contours defined in the external wall surface;

wherein each sunken ergonomic rail mount section is formed of at least first and second transversely aligned, parallel rounded notches, each shaped as a trough or radiussed groove having a substantially linear groove bottom surface which is bounded by angled wall segments, where the angle between the linear groove bottom surface and the angled wall segments at opposing ends is 45 degrees;

wherein each sunken rail mount section thus defines an integral sunken rail segment having spaced notches terminating in angled wall segments which terminate laterally at opposing ends to define a rail segment width of 0.835 inches, wherein the lateral ends of each rail section notch are configured as laterally opposed wedge-shaped clamping surfaces which each define an outside corner rebated wall segment which intersects the outwardly facing angled wall segment at 90 degrees, and wherein said sunken rail mount section clamping surfaces are within or inside of the outer circumferential surface of the forend's outer surface.

22. The rifle forend assembly of claim 21, wherein said forend's outer surface has an outside diameter of approximately two inches and is knurled or textured, to provide a comfortable but secure gripping surface.

23. The rifle forend assembly of claim 21, wherein said transverse notches are defined in said sidewall outer surface which is tubular, and wherein said notches are defined between and bounded by first and second spaced elongated grooves in the inter-groove width, and the transverse notches extend substantially from the first elongated groove to the second elongated groove and so extend substantially all the way across the inter-groove width.

24. The rifle forend assembly of claim 23, wherein the linear transverse distance between the elongated grooves is the inter-groove width, along the transverse notches which is 21.2 mm or 0.835 inches and the same as the width of the top of a traditional Picatinny Rail segment, so accessories which are compatible with the Picatinny rail platform (MIL-STD-1913 or STANAG 2324) will easily engage and hold onto the forend assembly sidewall surface, where the transverse notch and the sidewall's elongate groove edges define the first and second elongated non-perforating grooves, all of which cooperate to provide an enhanced, snag-free mounting interface.

25. The rifle forend assembly of claim 21, wherein said mount interface is configured as a forend assembly adapted for use with a precision rifle or a service rifle which is adapted for attachment to releasable Picatinny-style mounts at multiple attachment locations along four quadrants while also allowing indexing of the forend assembly at multiple angular locations relative to the rifle.

26. The rifle forend assembly of claim 21, wherein each of transverse mounting notches has a cross sectional shape which is rounded or radiused, and said sunken rail mount provides a snag free surface which is configured to receive an accessory configured with a clamp to engage a MIL-STD-1913 Picatinny Rail mount, clamping inwardly against and compressing while engaging the opposing notch edge surfaces.

* * * * *